US005214800A

United States Patent [19]

Braun

[11] Patent Number: 5,214,800

[45] Date of Patent: Jun. 1, 1993

[54] COLLAPSIBLE, FLEXIBLE HEAD WEAR

[76] Inventor: Christopher Braun, 916 Whitegate Dr., Mount Prospect, Ill. 60056

[21] Appl. No.: 515,221

[22] Filed: Apr. 27, 1990

[51] Int. Cl.[5] ..... A42B 1/04; A42B 3/00

[52] U.S. Cl. ..... 2/173; 2/200; 2/205; 2/206; 446/27; 446/488

[58] Field of Search ..... 2/206, 200, 171, 173, 2/196, 197, 209.1, 424, 9, 205; 229/8; 446/27, 80, 488, 388

[56] References Cited

U.S. PATENT DOCUMENTS

| | | | |
|---|---|---|---|
| 727,173 | 5/1903 | Merrell | 2/206 |
| 1,398,165 | 11/1921 | Whiteside | 2/202 X |
| 1,600,086 | 9/1926 | Bixby | 446/488 X |
| 2,000,242 | 10/1933 | Manning | 2/173 |
| 2,441,333 | 5/1948 | Reinsberg | 2/206 UX |
| 2,677,133 | 5/1954 | Hoffman, Jr. | 2/206 |
| 2,722,688 | 11/1955 | Wojnar | 2/205 |
| 2,832,961 | 5/1958 | Weiss | 2/200 X |
| 2,856,608 | 10/1958 | Wagenfeld | 2/200 X |
| 3,134,984 | 4/1962 | Ward | 2/206 |
| 3,221,345 | 12/1965 | Berg | 2/200 X |
| 3,295,511 | 1/1967 | Crouzet | 2/205 X |
| 3,599,240 | 8/1971 | Shapur | 2/206 X |
| 3,789,839 | 2/1974 | Lund et al. | 2/206 X |
| 3,917,153 | 11/1975 | Holschneider | 446/27 X |
| 4,027,340 | 6/1977 | Hadtke | 2/206 |
| 4,411,023 | 10/1983 | Pinson | 2/205 X |
| 4,572,173 | 2/1986 | Comeau | 2/202 X |
| 4,870,959 | 10/1989 | Reisman et al. | 2/205 X |

FOREIGN PATENT DOCUMENTS

| | | | |
|---|---|---|---|
| WO90/5565 | 5/1990 | PCT Int'l Appl. | 2/205 |

*Primary Examiner*—Peter Nerbun

[57] ABSTRACT

A collapsible, foldable, mask is provided which is made from a single blank, creased or folded to make a front and a back panel, with the fold forming the tops of both panels. The sides of the front panel are joined for a portion of their length to the corresponding sides of the back panel. The mask can be stored or shipped in a flat two-dimensional, partly assembled mode and can be opened or assembled to their dimensional form to be worn on the head of a user.

4 Claims, 6 Drawing Sheets

COLLAPSIBLE, FLEXIBLE HEAD WEAR

BACKGROUND OF THE INVENTION

This invention relates to improvements in flexible masks and, more particularly, to flexible masks that maybe stored flat and can be opened up to three dimensional form to cover the face, top and back of a user's head to simulate football helmets, space helmets, current super heroes, team mascots, and the like.

Heretofore, known flexible masks have included two dimensional face masks, three dimensional face masks which extend partly around the side of a wearers head, and full head masks made of multi-folded bag like material. Such masks are shown and described in U.S. Pat. Nos. 727,173; 2,000,242; 3,134,984; 3,599,240; and 3,917,153.

Additionally, other three dimensional elaborate masks exist which are usually made of rubber, and realistically portray the head and face of a pre-determined character or object. These masks, however, are expensive to manufacture, bulky to store, and are somewhat uncomfortable when worn because perspiration builds up between the user's skin and the inside rubber surface of the mask.

A need has arisen for a relatively simple mask, that is assembled from a single blank, can be stored easily in a flat mode, and which when worn as a three dimensional mask has the desired character or object depicted thereon covering the 360 degree circumference of the outer surface of the mask.

SUMMARY OF THE INVENTION

The invention is briefly described as a mask to cover the head of a person, cut from a blank, having a fold through the center of the blank to create a front and back panel. Each of the front and back panels have a topside, two opposing sides, and a bottomside. The front and back panels are separated by a crease defining the topside of each, and are joined along their respective sides for at least a portion of the length thereof.

BRIEF DESCRIPTION OF THE DRAWINGS

The features of the present invention, which are believed to be novel, are set forth with particularity in the appended claims. The invention together with further objects and advantages thereof may be best understood by reference to the following detailed description taken in conjunction with the accompaning sheets of drawings in the several figures of which like reference numerals identify like elements, and in which:

DETAILED DESCRIPTION OF THE PREFERRED EMBODIMENTS

Figure 1:
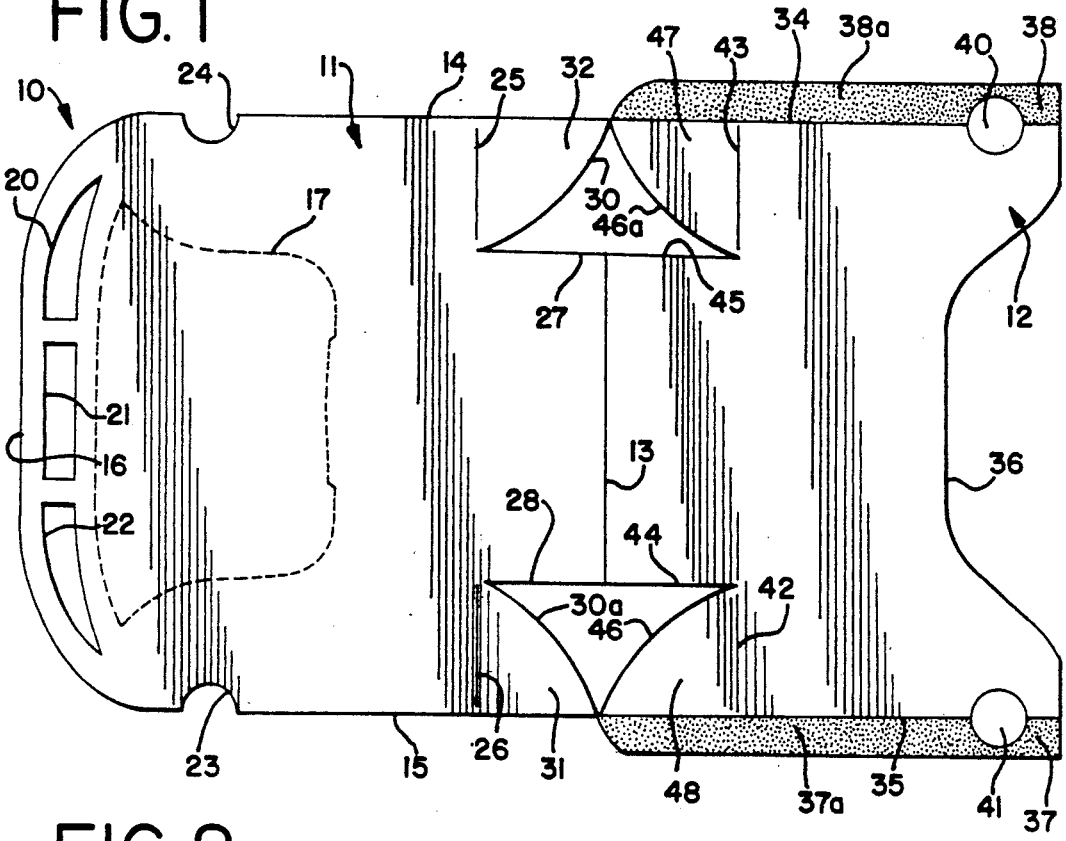
FIG. 1 is a top plan view of a blank mask constructed in accordance with the present invention showing a first embodiment football helmet mask.
Figure 2:
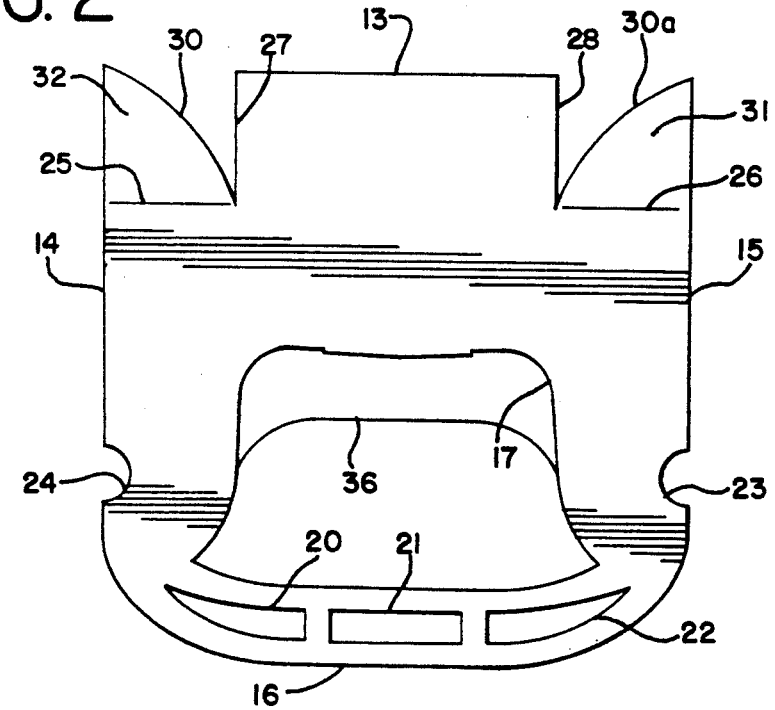
FIG. 2 is a front elevational view of the first embodiment shown in its flat, two dimensional storage mode.
Figure 3:
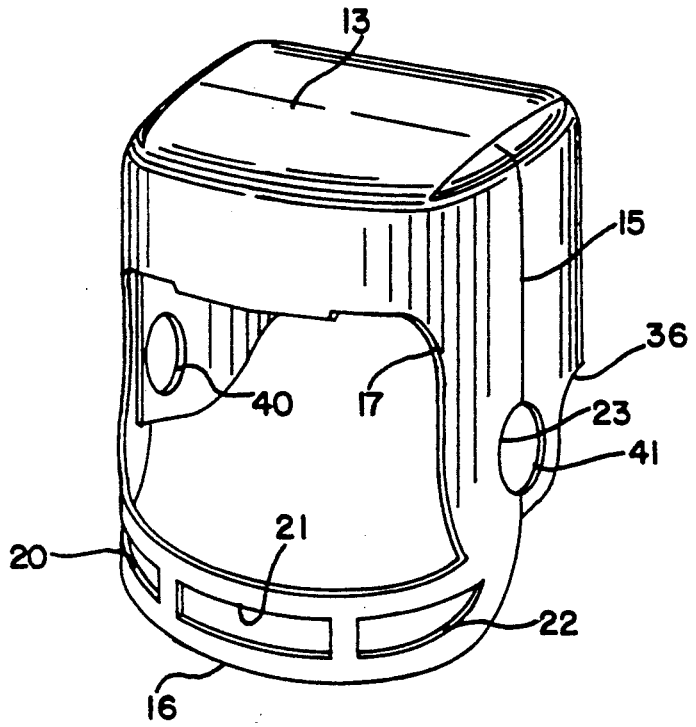
FIG. 3 is a perspective view of the first embodiment in fully assembled three dimensional form.

Referring to FIGS. 1–3, a cardboard blank, generally indicated at 10, constructed in accordance with the present invention to depict a football helmet, includes a front panel 11 and a back panel 12 separated by a first side score line or hinged fold 13. The front panel 11 has three additional main sides or edges, including sides 14 and 15, and bottom 16.

As shown in FIG. 1, the front panel 11 has a closed loop perforation line 17 which may be punched out and removed to create the front opening of the helmet. Additional openings 20, 21, and 22 positioned below perforation line 17 give the appearance of having a face guard. The front panel 11 further includes semicircular openings 23 and 24 in communication with the sides 14 and 15, respectively, to be discussed in more detail below. The front panel further includes two substantially identical tabular half portions 31, 32 created by cut lines 14, 30 and score line 25 on one side of the front panel 11, and by cut lines 15, **30*a* and score line 26 on the opposing side of the front panel. The top of front panel 11 includes a central portion extending from hinge fold 13 and defined by cut lines 27, 28 which extend generally perpendicularly from fold 13 down to score lines 25, 26**, respectively.

The back panel 12 of the blank 10 also has three main sides edges in addition to fold line 13, including two opposed sides or edges 34 and 35, and a bottom side on edge 36 which, in this embodiment, is contoured to imitate the back of a football helmet. Back panel 12 further includes, along and outside of each of side edges 34 and 35, respectively, elongate substantially retangular strips of material 37 and 38, which are preferably coated with an adhesive substance, 37A, 38A, respectively, along their lengths.

Back panel 12 further includes circular openings 40 and 41 which are adapted to align with semi-circular openings 23 and 24 on the front panel, when assembled, to correspond to similar side openings on a football helmet. Two opposing tabular portions 47, 48 on the back panel 11 formed by cut lines 34, **46*a* and score line 43, and cut lines 35, 46 and score line 42, respectively correspond to similar tabular portions 32, 31, respectively, on the front panel 10. The top of back panel 12 includes a central portion extending from hinge fold 13 and defined by cut lines 44, 45 which extend generally perpendicularly from fold 13 down to score lines 42, 43**, respectively.

During assembly, the blank 10 is folded along crease 13, the front panel 11 and back panel 12 are positioned parallel to each other, and strips 37 and 38 are folded over and are adhesively joined to panel 11 immediately inwardly adjacent side edges 14 and 15 on the backside thereof so that the folded panels have the two dimensional appearance shown most clearly in FIG. 2. Also, although the adhesive covered strips 37 and 38 are shown attached to back panels, they could also extend from the side of the front panels without departing from the scope of applicant's invention. When mask 10 is partially assembled in the form shown in FIG. 2, it may be shipped and stored inexpensively and efficiently, thus providing improvements over heretofore known masks.

Referring to FIG. 3, the football mask embodiment of the invention is shown in fully assembled, three-dimensional form with the tabular portions 32, 47 and 31, 48, respectively, folded under top fold 13 and retained thereunder to enclose the top of the mask and provide a flexible transition from the top to the sides of the mask. It will be understood that the outside surface of mask 10 may have imprinted thereon the colors of predetermined schools or professional football teams, or other desired color schemes. Further, the cardboard defined by cut-line 17 may have appropriate advertising imprinted thereon to help defray the cost of producing the mask.

Figure 4:
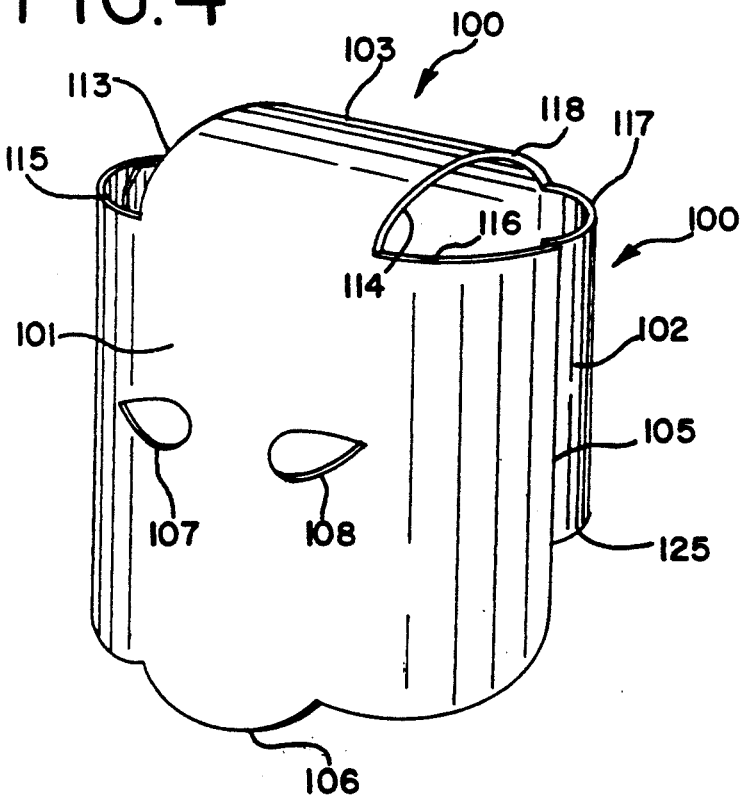
FIG. 4 is a perspective view of a second embodiment of the invention shown in three dimensional form.
Figure 5:
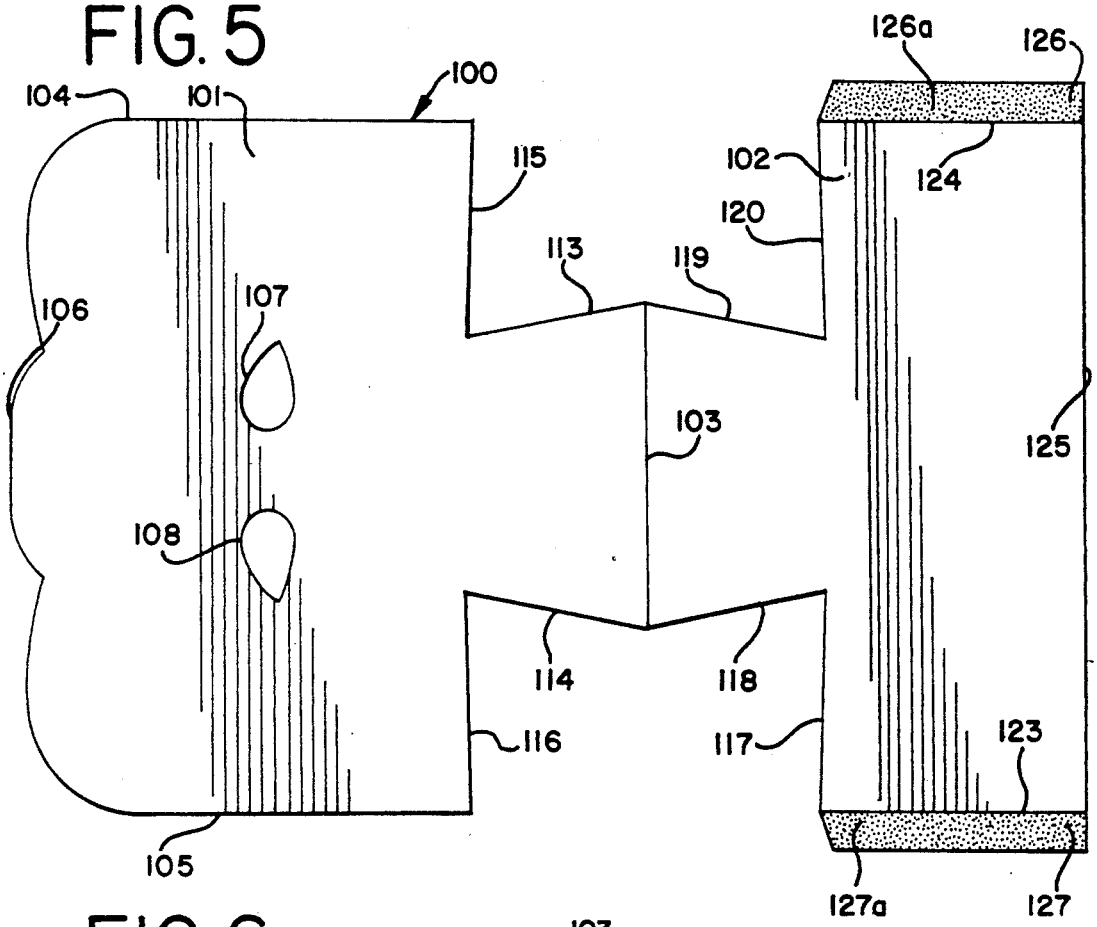
FIG. 5 is a top plan view, similar to FIG. 1, of the second embodiment of the invention.
Figure 6:
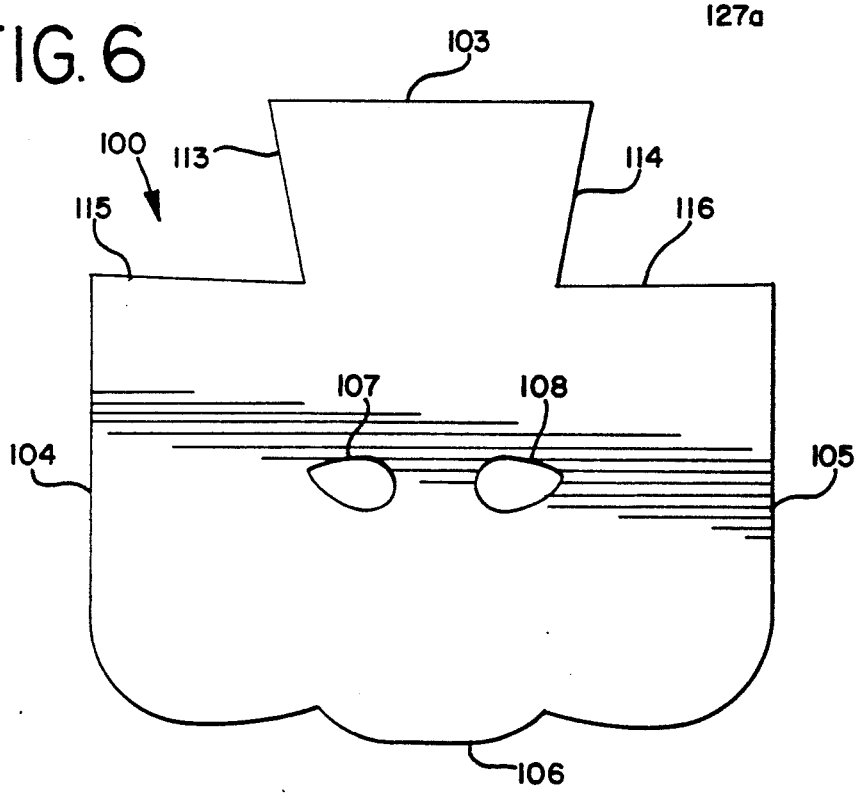
FIG. 6 is a front elevational view, similar to FIG. 2, of the second embodiment of the invention shown in its flat two-dimensional storage mode.

Referring to FIGS. 4, 5, and 6, a second embodiment of the mask, generally indicated at 100, includes in its blank form, as shown in FIG. 4, a front panel 101 and a back panel 102 separated by a fold line or crease 103 there between. The front panel 101 has opposing sides 104 and 105 and bottom edge 106, and further includes a pair of appropriately positioned eye holes 107 and 108. Furthermore, the front panel 101 has opposed pairs of cut lines 113, 115 and 114, 116, similar to those on the first embodiment.

The back panel 102 has opposing side edges 123 and 124. The bottom edge 125 is, in this case, a straight line. Opposed pairs of cut lines 117, 118 and 119, 120, respectively, extend inwardly between the top fold line 103 and the side edges 123, 124. As in the case of the first embodiment 10, the back panel 102 has two opposed elongate strips 126 and 127, extending from side edges 123, 124, respectively. Adhesive material 126A, 127A is applied to the outside surface of those strips.

When the blank 100 of the second embodiment is folded along fold line 103, to the two-dimensional form as shown in FIG. 6, the front panel 101 overlaps the back panel 102, and the side edges 104 and 105 of the front panel become congruent with side edges 123 and 124 of the back panel. The elongate strips 126 and 127 on the back panels can be folded so that the adhesive 126A, 127A engages the rear side of the front panel inwardly adjacent side edges 104, 105. As with the first embodiment 10, the mask 100 of the second embodiment may be economically and efficiently shipped or stored in the two-dimensional form shown in FIG. 6.

As shown most clearly in FIG. 4, the completely assembled three-dimensional mask 100 will fit over the head of a user similarily to mask 10 of the first embodiment. However, the mask is less expensive to make because there is no joinder between the cut out portions 114, 116; 113, 115; 117, 118; and 119, 120. As mask 100 is warn by a user, the respective edges 113–120 are positioned closer to their adjacent edges as the head size of the user increases. As the second embodiment 100 does not have an open face, it is a more traditional mask than is the first embodiment 10.

Figure 7:
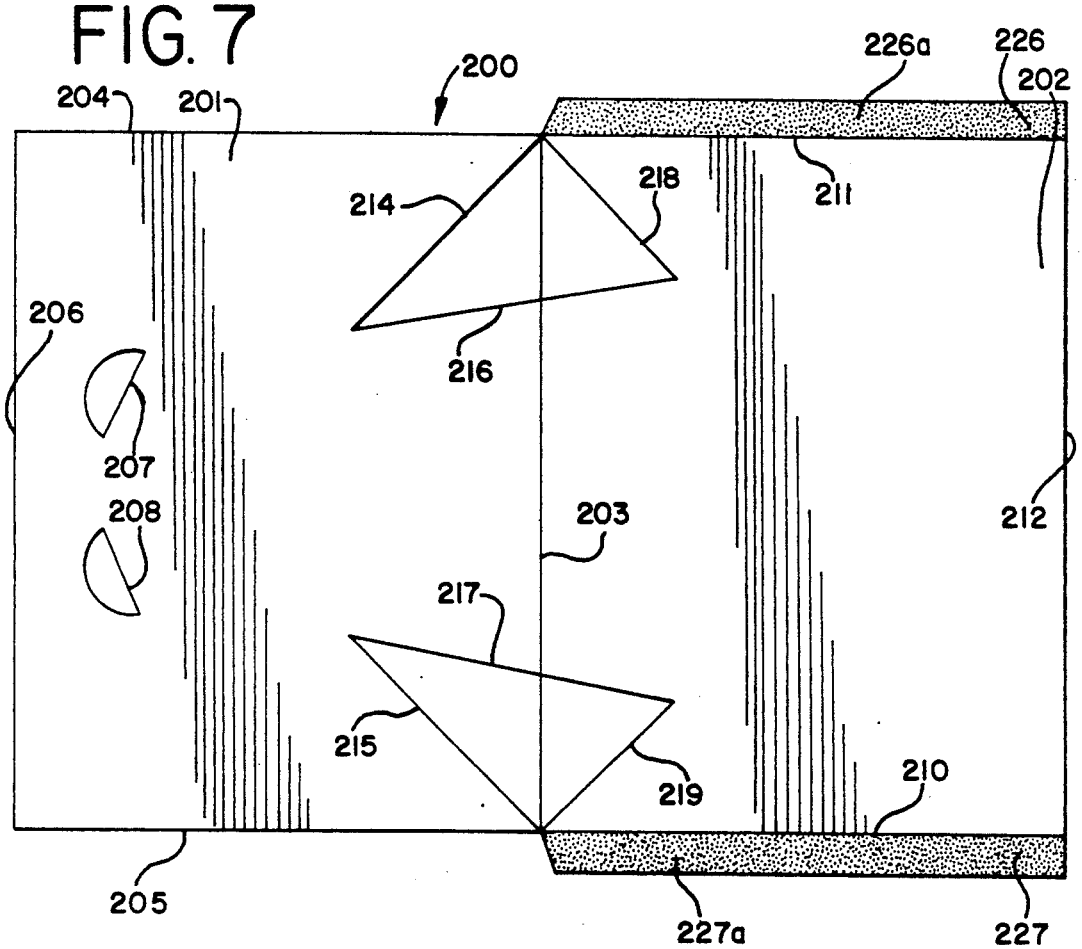
FIG. 7 is a top plan view, similar to FIG. 1, of a third embodiment of the present invention shown as a blank.
Figure 8:
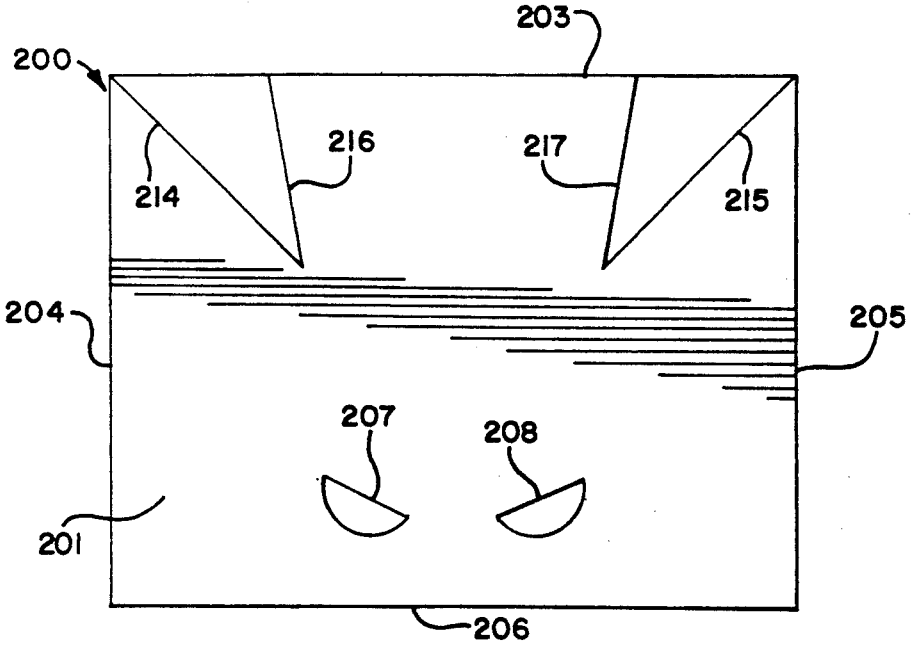
FIG. 8 is a front elevational view of the third embodiment shown in its flat, two-dimensional storage mode.
Figure 9A:
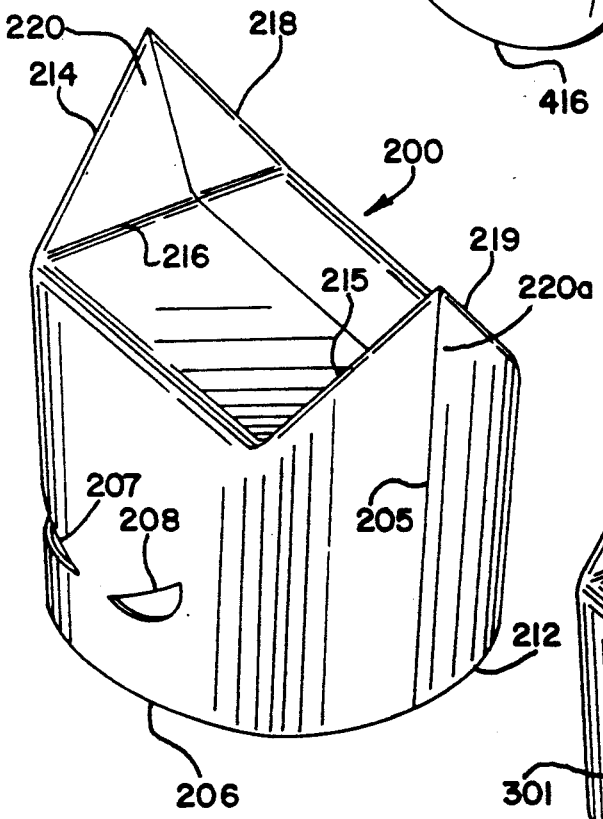
FIG. 9A is a perspective view of the third embodiment of the invention shown in fully assembled, three-dimensional form.

Referring to FIGS. 7, 8, and 9A, a third embodiment of the invention, which is similar in many respects to the first two embodiments, is shown in blank at 200, and it includes a front panel 201 and a back panel 202, separated by a fold line or crease 203. Front panel 201 further includes side edges 204 and 205 and, in this embodiment, a flat bottom panel 206. Similarily to the second embodiment 100, the third embodiment 200 includes a pair of eye apenture openings 207, 208. From the position of eye openings 207, 208, mask 200 does not extend as low on a user's head as do the masks of the first two embodiments. In this embodiment, the top crease 203, opposed sides 204, 205, and the bottom 206 form a right rectangle.

Back panel 102, in addition to top crease 203, includes opposed sides 210, 211 and a bottom side 212, all forming a right rectangular shape for panel 202. As in the first two embodiments, a pair of elongate strips 226, 227 extend outwardly from opposing sides 211, 210, respectively, substantially along the lengths thereof. Strips 226, 227 preferably include adhesive 226A, 227A on the outside thereof. The strips may be folded along crease lines 210, 211 and adhered to the inside surface of panel 201, when the panels are folded along crease 203 to juxtaposed position.

As shown most clearly in FIG. 7, an opposed pair of triangular score or crease lines 214, 216 and 218, and 215, 217 and 219, respectively, bridge across panels 201 and 202 and extend inwardly from their apexes positioned at the opposed joinders of crease 203 with front and back panel sides 201, 211, and opposite front and back panel sides 205, 210, respectively. The hypotenuses 216, 217 of the respective triangles are not parallel in the third embodiment, but are inclined slightly as their extentions would intersect outwardly of the bottom side 206 of the front panel 201. The function of these score lines will be discussed in more detail below.

Referring to FIG. 8, the mask 200 of the third embodiment may also be folded flat for ease and efficiency of shipping and storage, especially when packed in quantity with other such masks.

Referring to FIG. 9A, the mask 200 of the third embodiment is shown in fully assembled, three-dimensional form suitable for being worn over the head of a user. The two ears 220, 220A defined on their inside surface by triangles 215, 217 and 219 and 214, 216 and 218, respectively, are formed when the crease 203 is pushed inwardly of the mask while pulling the bottom of front and back panels 201, 202 apart at their centers.

The mask somewhat snaps into its three-dimensional position as the top central portions of front panel 201 and back panel become a relatively flat top. The two opposing ears aid the rididity of the assembled mask. Such a mask may be suitable for use as catlike characters, the comic strip character known under the trademark Batman, or the like.

Figure 9B:
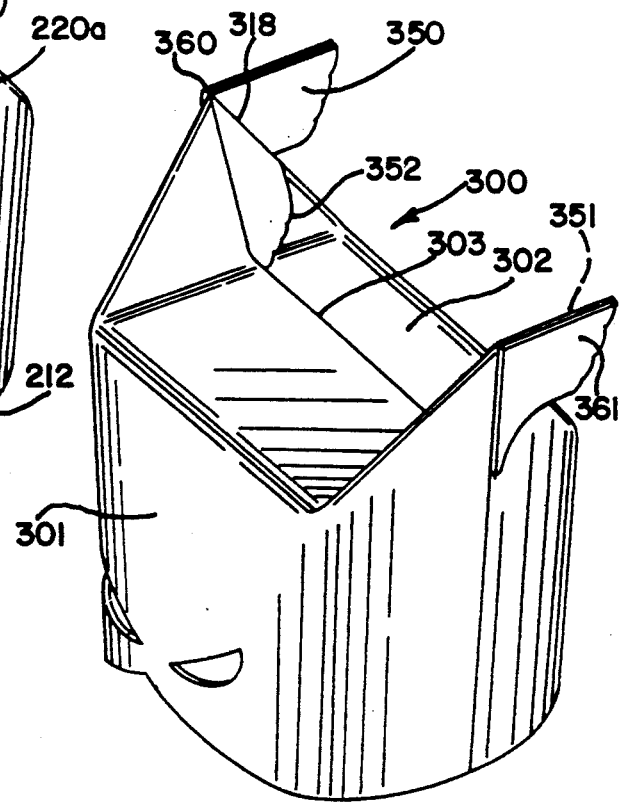
FIG. 9B is a perspective view of a modification of the third embodiment of the present invention with a top portion of the mask cut-out and extending backwardly.

Referring to FIG. 9B, a modification of the mask 200 shown in FIG. 9A is designated generally at 300, and is very similar to mask 200 with the exception of opposed wing portions 350, 351 which are cut from the two opposed end portions of the top of the back panel 302. Wing portions 350, 351 are cut partly along crease 303 and may be cut in any desired configuration, such as along line 352 shown in FIG. 9B. The wing is straightened along line 318, which is line 218 in FIG. 9A, so that it may extend backward in winged fashion. In embodiment 300, a pair of colored flat panels 360, 361 are adhered to the outside of panels 350, 351, respectively, to enhance the winged features of the mask and to maintain the wings in a relatively stiff unbending position. Such a mask 300 may be used to portray any winged character, such as the Mercury, the character known under the mark Captain America, or the like.

Figure 10:
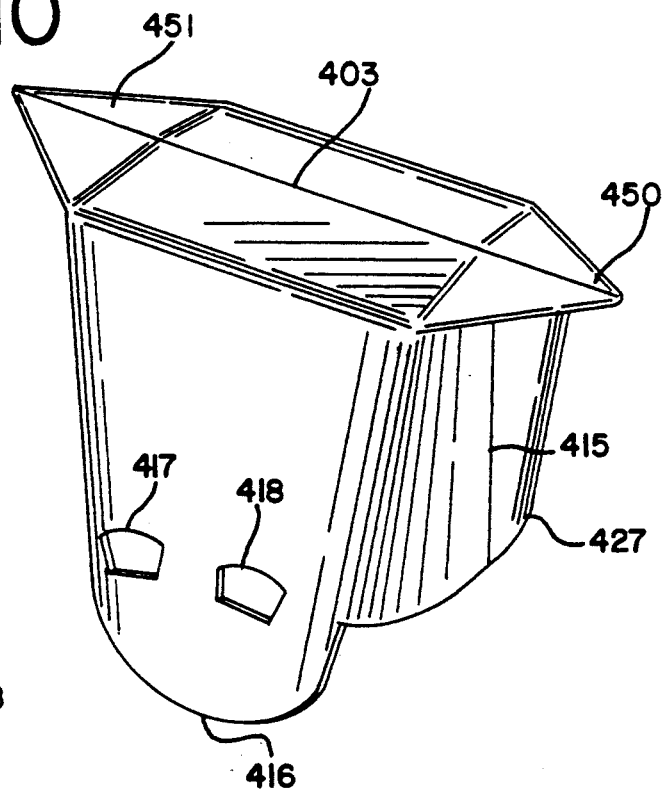
FIG. 10 is a perspective view of a fourth embodiment of the present invention.
Figure 11:
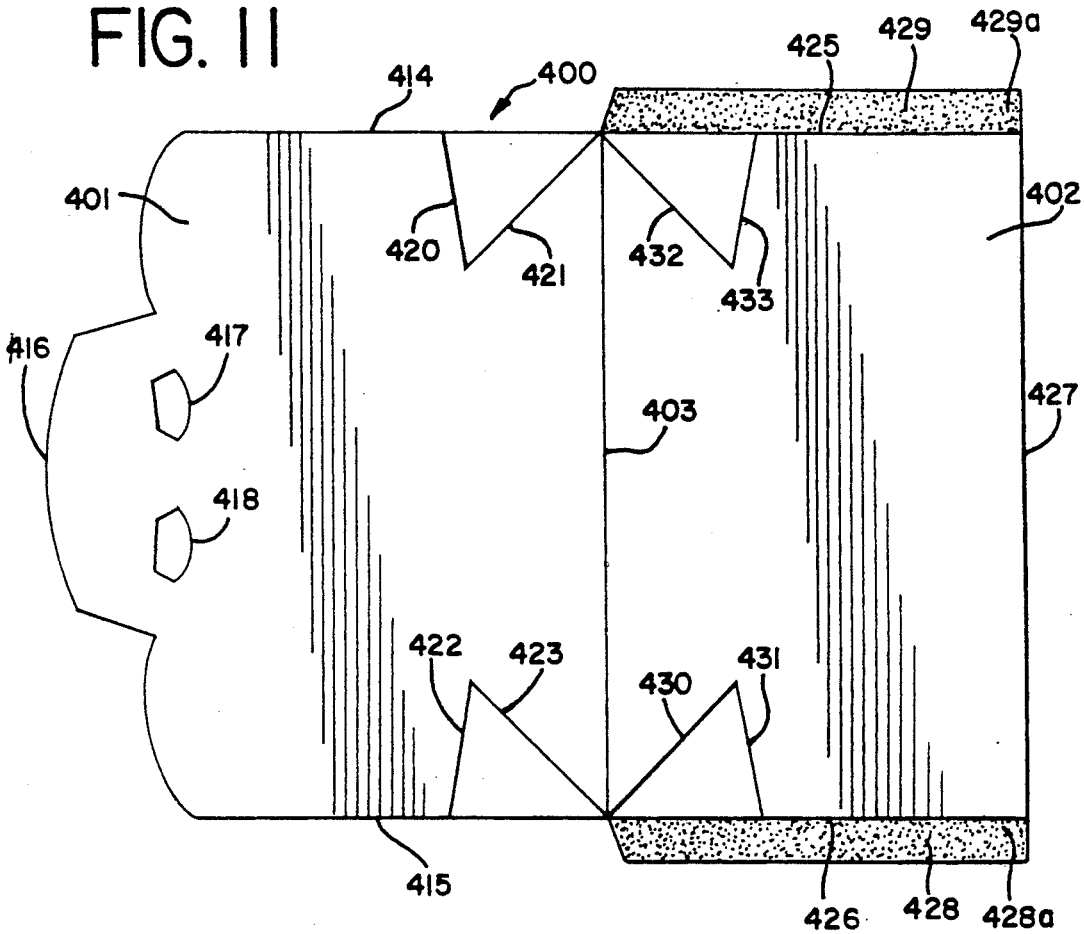
FIG. 11 is a top plan view of the fourth embodiment shown in blank form.
Figure 12:
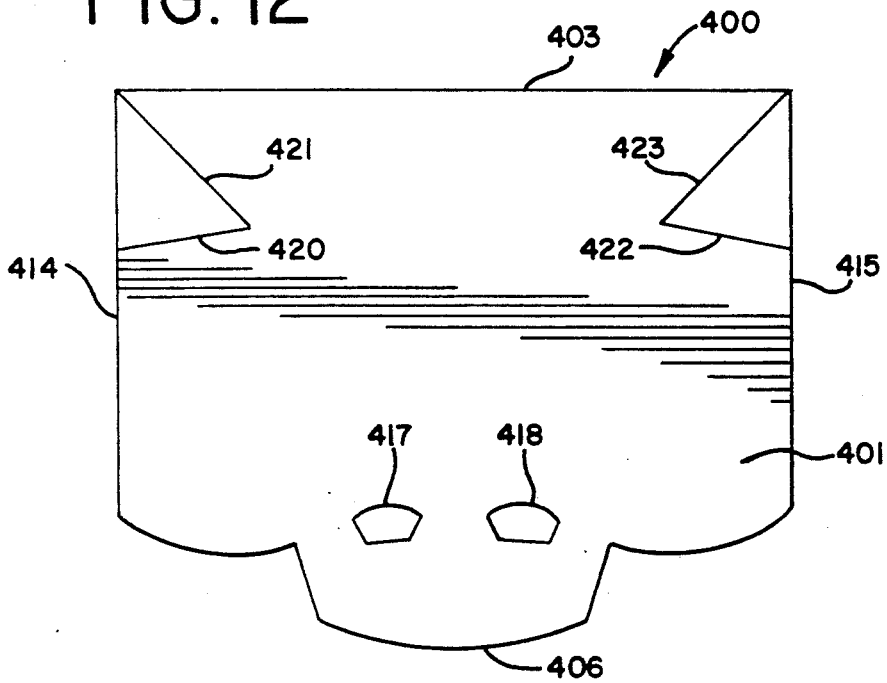
FIG. 12 is a front elevational view of the fourth embodiment shown in its flat, two-dimensional storage mode.

Referring to FIG. 10, 11 and 12, a fourth embodiment of the invention, generally indicated at 400, and is shown in blank form in FIG. 11, includes, similarily to the previous embodiments, a front panel 401 and a back panel 402, which are separated by a fold line on crease 403. Front panel 401 includes opposed sides or edges 414, 415 which, in this embodiment, extend perpendicularly from crease 403, and a bottom side or edge 416 designed to imitate a long nose or snout of an animal or other character.

As in the second and third embodiments, front panel 401 includes a pair of eye holes or apertures 417, 418. Front panel 401 further includes a pair of opposed triangular scored or creased portions defined by lines 420, 421 and 414 on one side, and by lines 422, 423 and 415 on the opposing side. The triangular portions will be discussed in greater detail below.

Back panel 402 includes opposed sides or edges 425, 426 which entend perpendicularly from crease 403, and a bottom side edge 427. Back panel 402 further includes a pair of elongate opposed strips 428, 429 which extend outwardly of side edges 426, 425, respectively, and substantially along the lengths thereof. Strips 428, 429 include adhesive 428A, 429A, positioned on their outer surfaces. Back panel 402 further includes an opposed pair of triangles defined by score or crease lines 430, 431 and 426 on one side, and 432, 433 and 425 on the opposing side.

As shown most clearly in FIG. 12, the front and back panel are partially assembled by folding panels 401 and 402 along top crease 403, and by folding side panels 428 and 429 so that their adhesives 428A, 429A retainingly engage the inside surface of front panel 401, inwardly adjacent the side edges 415, 414, respectively, to form a two-dimensional partly assembled mask suitable for efficient shipping and storage.

Referring to FIG. 10, the fourth embodiment 400 of the present invention also includes a pair of ears 450, 451 on opposing sides of the mask that stick outwardly from the sides of the mask in the manner of bull horns, or the like. Ears 450, 451 run the length of crease 403 and it is the four triangles 414, 420, 421; 415, 422, 423; 425, 432, 433; and 426, 430, 431 forming the underside ears 450, 451 that bend at their score lines to bridge between the eartips and the sides of the mask 400. When the mask is opened by pushing on crease 403 while pulling the bottom centers of front panel 401 and back panel 402 until the mask opens as is shown in FIG. 10. It should be noted that mask 400 may be equiped or modified to include cutout portions that stick up similarly to the cutout portions 350, 351 in the modification shown in FIG. 9B.

In all cases, the masks can be easily stored in either their blank form as shown in FIGS. 1,5,7 and 11 or may be partly assembled, that is folded along the top lines or crease with the side strips adhesively connecting the front and back panels at their respective sides as most shown in FIG. 2,6,8 and 12.

Thus an improved mask has been shown and described. While four embodiments and a modification of one embodiment of the invention have been shown and described, it will be obvious to those skilled in the art that changes and modifications may be made without departing from the invention in its broader aspects. Therefore, the aim of the appended claims are to cover the true spirit and scope of the present invention.

The invention is claimed as follows:

1. A blank for forming three dimensional head wear adapted for positioning on the head of a user, said blank comprising:

a front panel and a back panel sharing a common first side defining at least a portion of a top of said head wear, said front panel including opposed second and third sides extending from one of said common side and an extension of a line coincident with said common side, said back panel including opposed second and third sides extending from one of said common side and an extension of a line coincident with said common side, said second side of said front panel being adapted for side edge engagement with said second side of said back panel, and said third side of said front panel being adapted for side edge engagement with said third side of said back panel, tab members extending from said front and back portions forming partial outlines of said cut out portions, each of said tab members being positioned for retention under said common first side when said mask is in assembled condition.

2. The blank as defined in claim 1 wherein said front panel further includes at least one cut-out portion thereon for providing user visibility when wearing said head wear.

3. A blank for forming three dimensional mask adapted for positioning on the head of a user, said blank comprising:

a front panel and a back panel sharing a common first side defining at least a portion of a top of said mask, said front panel including opposed second and third sides extending from one of said common side and an extension of a line coincident with said common side, said back panel including opposed second and third sides extending from one of said common side and an extension of a line coincident with said common side, said second side of said front panel being adapted for side edge engagement with said second side of said back panel, said third side of said front panel being adapted for side edge engagement with said third side of said back panel, said blank including first and second opposed top cut out portions, said first and second opposed to cut out portions each including at least two side edges having a joinder therebetween and being substantially symmetrical in shape with respect to said common side of said front and said back panels and each being positioned so that a point along the perimeter of each cut out portion coincides with one of the points of convergence of an extension of said common side and said front and back panel second sides, and an extension of said common side and said front and back panel third sides, respectively.

4. The blank as defined in claim 3 further including, a first elongate tab portion extending from one of said front and back panel second sides and having adhesive means thereon for retaining said front panel second side and said rear panel second side in engaging relation, and a scond elongate tab portion extending from one of said front and back panel third sides and having adhesive means thereon for retaining said front panel third side and said rear panel third side in engaging thereon.

* * * * *